United States Patent [19]
Scherp et al.
[11] 4,267,773
[45] May 19, 1981

[54] SILKSCREEN PRINTING MACHINE

[75] Inventors: Sven Scherp, Södertälje; Sylve J. D. Ericsson, Tumba, both of Sweden

[73] Assignee: Svecia Silkscreen Maskiner AB, Norsborg, Sweden

[21] Appl. No.: 7,972

[22] Filed: Jan. 31, 1979

[51] Int. Cl.[3] ..... B05C 17/04; B41L 27/00
[52] U.S. Cl. ..... 101/123; 101/127.1
[58] Field of Search ..... 101/114, 115, 121-127, 101/129, 127.1

[56] References Cited

U.S. PATENT DOCUMENTS

| | | | |
|---|---|---|---|
| 2,895,412 | 7/1959 | Reed | 101/123 |
| 2,936,705 | 5/1960 | Hall | 101/123 |
| 3,731,623 | 5/1973 | Bubley | 101/123 |

FOREIGN PATENT DOCUMENTS

| | | | |
|---|---|---|---|
| 6608429 | 12/1967 | Netherlands | 101/123 |

*Primary Examiner*—Edgar S. Burr
*Assistant Examiner*—A. Heinz
*Attorney, Agent, or Firm*—Burns, Doane, Swecker & Mathis

[57] ABSTRACT

A silkscreen printing machine having a large printing table and a stencil related thereto stretched across said table, said machine being provided with means for moving a squeegee relative to said stencil and for pressing printing ink through the stencil into a material to be printed upon placed on said table. During a printing sequence, and at least during the first and latter stages of said sequence when the squeegee is pressed into abutment with the stencil and when the stencil, located parallel with the printing table is caused to sag by its own weight to an extent such that the stencil at other regions than the engagement point of the squeegee should abut the material or the printing table, the stencil is arranged to adopt an oblique position relative to the printing table such that the angle between said stencil and said table at said squeegee engagement point exceeds 0°, meaning that the stencil abuts solely the material at the said engagement point. The movement of the frame is controlled by a plurality of operating rods, whose actuation is dependent upon movement of the squeegee and its position along the stencil.

4 Claims, 6 Drawing Figures

SILKSCREEN PRINTING MACHINE

FIELD OF THE PRESENT INVENTION

The present invention relates to a printing machine arranged to apply a colour print to a material to be printed upon, and preferably, although not exclusively, to a silkscreen printing machine provided with a large printing table and a stencil related thereto. The stencil is firmly mounted or stretched in a frame arranged over the table. The printing machine is also provided with means for causing relative movement between a squeegee and the stencil, thereby, to press printing ink through the stencil against the material to be printed upon placed on said table.

DESCRIPTION OF THE PRIOR ART

It is normal in silkscreen printing machines that, when the stencil is not activated by the squeegee, the stencil is spaced from the material to be printed upon and resting on the printing table, through a distance designated "off-contact". This off-contact is preferably equal over the whole of the printing surface. Further, it is a necessary prerequisite if a distinct print is to be obtained, that the stencil is controlled by the squeegee in a manner such that it will only contact the material to be printed upon at the point of engagement of the squeegee with the stencil. If the stencil abuts the material to one side of this point of engagement of the squeegee, the print at these regions will be obscure, because the ink smears in the fabric of the material on the printing surface.

In the case of silkscreen printing machines having a stencil size of less than 2×3 meters, it has been found possible to maintain the desired off-contact without taking special measures. In the case of very small stencils, for example of 1×2 meters, the stencil material and ink-filling means hitherto used has not been encumbered with any problems in respect of maintaining the desired off-contact during the whole of the printing process, since the extent to which the stencil sags as a result of the weight of the stencil, and above all the weight of the ink, has been negligible and lies well within permitted tolerances, i.e. satisfactory off-contact is obtained.

None of the aforementioned problem is encountered in stencils up to 2×3 meters, since the extent to which the center part of the stencil hangs down under the weight of (a) the stencil material, (b) the stencil itself and (c) the ink, is still so small that a clearly defined print can be obtained when the squeegee is displaced, as a result of satisfactory off-contact.

OBJECTS OF THE PRESENT INVENTION

The present invention relates, however, to a silkscreen printing machine having a printing table, and a therewith related stencil, of such large magnitude that unless no measures are taken when the squeegee is displaced the stencil will lie against the material to be printed upon even in the regions externally of the engagement point of the squeegee, the result being an unclear print as a result of ink smearing on the printing surface.

Just how large a stencil must be before the present invention must, of necessity, be applied, is difficult to establish in size, since the critical size is dependent upon the amount of tension in the stencil, the material from which it is made, the material from which the stencil itself is made and the thickness of ink on the stencil. The invention, however, can be used to advantage with stencils over 2×3 meters in size.

The stencil may have a size of over 2×6 meters. It has been found that when a stencil of such a size is stretched in a frame in the conventional manner, the weight of the printing ink, the weight of the stencil material and the weight of the stencil itself cause the centre of the stencil to sag by 5–6 cm. In practice, this amount of sag renders a clear print impossible. If it is assumed that the stencil is arranged parallel to the printing table and the intrinsic weight of the stencil would cause it to sag to an extent such that the stencil contacts the material or the printing table at regions other than the point of engagement of the squeegee, an unclear or smeared print will result therefrom. This smeared print occurs mainly at the first stage and the last stage of the printing process.

The present invention proposes means whereby this problem can be overcome and an object of the present invention is to ensure that the print is clearly defined even when the stencil is of such size that the sagging of said stencil will render an clear print impossible without the provision of additional measures.

An object of the present invention is to provide means whereby the stencil and stencil frame can be pivoted about one or more pivot centers located at the center part of the frame, thereby to regulate the setting position of said stencil and said frame.

Another object of the invention is to provide means whereby in the first part of a printing sequence, the part of the frame in which the stencil is mounted located in the direction of movement of the squeegee is higher from the printing table than that part located opposite the said movement direction. On the other hand, it is also an object of the present invention that during the last part of said printing sequence, the part of the frame located in the direction of movement of the squeegee is lower down towards the printing table than that part which is located opposite said movement direction of said squeegee.

Thus, the object of the present invention is that when the squeegee is urged into abutment against the stencil, the stencil is arranged, through its frame, to adopt an oblique position relative to the printing table of such magnitude that the angle between the stencil and the printing table at the engagement point of the squeegee exceeds zero degrees at both sides of said engagement point.

The main characterizing features of an arrangement according to the invention are disclosed in the characterizing clause of the accompanying claim 1.

BRIEF DESCRIPTION OF THE DRAWINGS

So that the invention will be more readily understood and optional features thereof made apparent, an exemplary embodiment thereof will be described with reference to the accompanying schematic drawings, in which.

DESCRIPTION OF A PREFERRED EMBODIMENT

Figure 1:
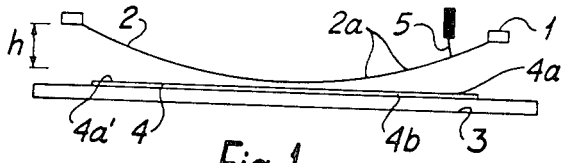
FIG. 1 is a side view, greatly simplified, of a stencil stretched in a frame, said stencil being caused to sag because of the weight of the printing ink, the stencil and its intrinsic weight, said degree of sag being greatly exaggerated in the Figure.

FIG. 1 illustrates, greatly simplified, a frame 1 forming part of a silkscreen printing machine, said frame 1 having stretched therein a stencil 2. A printing table is referenced 3 and a material to be printed upon is referenced 4.

A squeegee 5 is arranged to co-operate with the stencil 2, said squeegee being lowerable towards to the table 3 and arranged to be moved to the left, as seen in FIG. 1, whereby printing ink is forced through the stencil onto the material 4.

Since the means required to operate the silkscreen printing machine, i.e. the means for displacing the material 4 to the position shown in the figure, for registering the material correctly relative to the table 3, the means for moving the squeegee across the stencil, and the means for raising and lowering the frame, do not form any part of the present invention, these means are not illustrated.

As mentioned in the aforegoing, the invention is directed towards a large printing table and a stencil related thereto. The stencil 2 is mounted in the frame 1, and because of the weight of the printing ink, the weight of the stencil itself and the intrinsic weight of the stencil, a sag, designated "h" in FIG. 1, of a magnitude of 5–6 cm is obtained. This means that when the squeegee 5 is lowered towards the material 4 to be printed upon, as indicated at 4*a*, the part 2*a* of the stencil will abut the material 4, as shown at 4*b*, as resulting in a undefined or smeared print.

Figure 2:
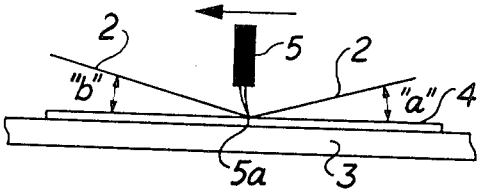
FIG. 2 illustrates an idealic printing condition in which the squeegee cooperates with the stencil to transfer print to material to be printed upon.

The ideal condition is illustrated in FIG. 2. When the squeegee 5 is moved in the direction of the arrow, there shall be found behind the squeegee an angle "a" between the stencil 2 and the material 4, whilst in front of the squeegee 5 there shall be an angle "b", such that the two angles between the stencil 2 and the printing angle 3 at the engagement point 5*a* of the squeegee exceed zero degrees.

Figure 3:
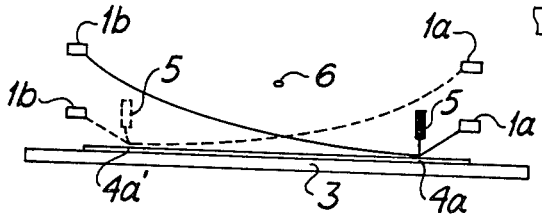
FIG. 3 is a side view, greatly simplified, of the arrangement according to FIG. 1 complemented in accordance with the present invention.

To this end, the present invention provides means whereby at least during the first and the second part of a printing sequence, when the squeegee is pressed against the stencil, as indicated at 4*a* and 4*a'*, the stencil 2 is arranged to adopt an oblique position relative to the printing table 3 such that the two angles between the stencil and the printing table at the engagement point of the squeegee exceed zero degrees. This is illustrated in FIG. 3, such that when the squeegee 5 engages the material at 4*a*, the frame part 1*a* takes a position closer to the printing table 3 than its opposite part 1*b*. As the squeegee 5 is moved to the position 4*a'*, the said part 1*a* is lifted at the same time as the part 1*b* is lowered, such that at the position 4*a'* of the squeegee 5 the part 1*a* takes a higher position above the table 3 whilst the part 1*b* of the frame takes a position closer to said table 3.

The frame 1 in which the stencil 2 is mounted is assumed to be pivotable about a pivot centre 6 in FIG. 3, this pivot centre being located at the centre part of the frame. This requires, however, a displacement of the stencil along the table, which could be compensated per se through a movement of the table.

Figure 4:
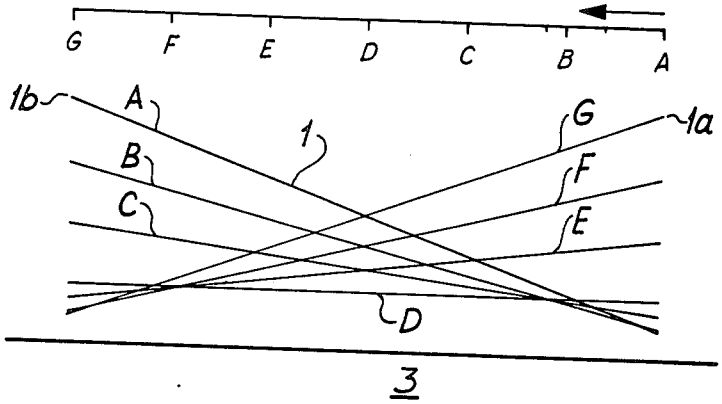
FIG. 4 is a side view of the arrangement according to the present invention showing the various setting positions of the frame in dependence upon the position of displacement of the squeegee along the stencil.
Figure 5:
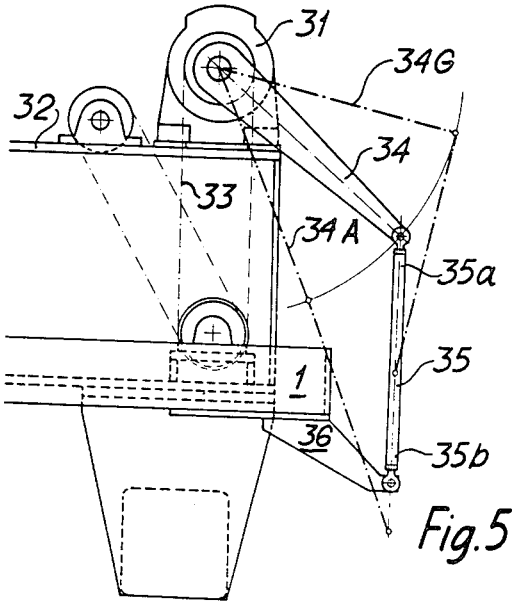
FIG. 5 illustrates one of four devices arranged to cooperate with the frame in dependence upon said displacement of said squeegee along said stencil, according to FIG. 4.
Figure 6:
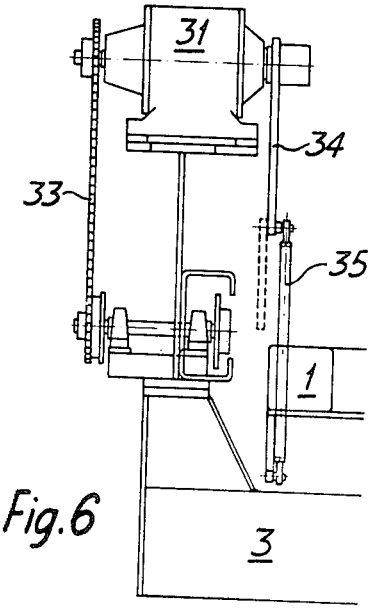
FIG. 6 is a front view of the device shown in FIG. 5.

FIGS. 4, 5 and 6, however, illustrate another embodiment.

FIG. 4 illustrates schematically different setting positions "A-G" of the frame 1 depending upon different corresponding positions of displacement "A-G" of the squeegee 5 along the table 3.

In FIG. 4 there is illustrated, greatly amplified, the pivoting movement of the frame 1 when using an arrangement according to FIGS. 5 and 6. The length of the frame 1 would actually have been ten times the length if the desired vertical scale had been used for raising and lowering the frame.

It will be seen from FIG. 4, however, that when the squeegee adopts position "A", the inclination of the frame 1 is such that the part 1*b* is located higher over the table 3 than the part 1*a*, nearest the table. When the squeegee adopts position "B", the frame 1 is tilted towards the horizontal position and adopts the horizontal position when the squeegee is located in position "B". When the squeegee is displaced further to positions "E", "F" and "G", the frame 1 tilts to the positions "E", "F" and "G" shown in FIG. 4.

In this embodiment the pivot point 6 is stationary, although the stencil frame is constantly fixed relative to the printing table.

FIGS. 5 and 6 shown one of four devices by which the frame can be moved according to the pattern illustrated in FIG. 4. It is assumed that these four devices operate in pairs, two being attached to the frame part 1*a* and two being attached to the frame part 1*b*. These devices are operated synchronously. Since all said devices are mutually identical, only one will be described with reference to FIGS. 5 and 6.

A gear mechanism 31 is fixedly connected to the framework 32 of the silkscreen printing machine. The gear mechanism 31 is driven by a chain 33, the movement of which is controlled directly by movement of the squeegee 5. The transmission is not shown for reasons of clarity.

When placing the squeegee 5 in position "A" the arm 34 adopts position 34A, whilst when placing the squeegee in position "G" the arm 34 adopts position 34G. The illustrated position corresponds to position "D". This means that the illustrated device co-operates with frame part 1*a*. The device cooperating with frame part 1*b* shall be set to a position corresponding to the position 34G when the illustrated device is set to position 34A.

The free end of the arm 34 is arranged to co-operate with one end 35*a* of a rod 35, the other end 35*b* of which rod is arranged to co-operate with an arm 36 mounted on the frame 1.

It should be mentioned here that the frame is controlled by means not illustrated in a manner such that the movement of said frame is purely a raising and lowering movement relative to the printing table, without relative horisontal movement between said frame and said table.

The invention is not restricted to the aforedescribed embodiments, but can be modified within the scope of the inventive idea. It should be mentioned that although the frame 1 of the illustrated embodiment is pivotable, the aforementioned problem can be resolved by causing the printing table to tilt or to be moved up and down.

What is claimed is:

1. A silkscreen printing machine, comprising:

a table;

a stencil mounted on a frame, said frame having first and second opposing ends;

support means for supporting said frame above said table;

a squeegee arranged above said stencil;

means for urging said squeegee against said stencil to press said stencil against and into contact with said table and for moving said squeegee relative to said stencil; and said support means including positioning means for vertically moving each of said ends of said frame relative to the table to position said frame at an oblique angle relative to said table to thereby enable said stencil to be positioned at an oblique angle relative to said table at the point of contact of said stencil with said table, said positioning means including at least one rotatable arm connected to said first end of said frame, at least one rotatable arm connected to said second end of said frame, means for rotating said rotatable arms, and means for transforming a rotational motion of said rotatable arms into independent vertical motion of said first and second ends of said frame.

2. The silkscreen printing machine according to claim 1 wherein said transforming means includes:

a rod, a first end of which rod is pivotably connected to each said at least one rotatable arm; and a connecting arm, a first end of which is fixed to an end of said frame, and a second end of which is pivotably connected to a second end of said rod.

3. The silkscreen printing machine according to claim 1 wherein said frame is pivotably mounted.

4. A silkscreen printing machine, comprising:

a table;

a stencil mounted on a frame, said frame having first and second opposing ends;

support means for supporting said frame above said table;

a squeegee arranged above said stencil;

means for urging said squeegee against said stencil to press said stencil against and into contact with said table and for moving said squeegee relative to said stencil; and said support means including positioning means for moving each of said first and second ends of said frame relative to said table to position said frame at an oblique angle relative to said table to thereby enable said stencil to be positioned at an oblique angle relative to said table at the point of contact of said stencil with said table, said positioning means including:

first and second pairs of connected rods, the rods of each pair being pivotably connected to one another;

a first arm, one end of which is connected to said first end of said frame and the other end of which is pivotably connected to one of said rods of said first pair of rods;

a second arm, one end of which is connected to said second end of said frame and the other end of which is pivotably connected to one of said rods of said second pair of rods; and means for imparting motion to said rods.

* * * * *